US011400355B1

(12) United States Patent
Joseph

(10) Patent No.: US 11,400,355 B1
(45) Date of Patent: Aug. 2, 2022

(54) BASKETBALL LAUNCHING DEVICE WITH A CAMERA FOR DETECTING MADE SHOTS

(71) Applicant: Shoot-A-Way, Inc., Upper Sandusky, OH (US)

(72) Inventor: John G. Joseph, Upper Sandusky, OH (US)

(73) Assignee: Shoot-A-Way, Inc., Upper Sandusky, OH (US)

( * ) Notice: Subject to any disclaimer, the term of this patent is extended or adjusted under 35 U.S.C. 154(b) by 96 days.

(21) Appl. No.: 16/894,005

(22) Filed: Jun. 5, 2020

Related U.S. Application Data

(60) Provisional application No. 62/858,524, filed on Jun. 7, 2019.

(51) Int. Cl.
*A63B 69/00* (2006.01)
*A63B 69/40* (2006.01)
(Continued)

(52) U.S. Cl.
CPC ..... *A63B 69/0071* (2013.01); *A63B 24/0021* (2013.01); *A63B 63/083* (2013.01);
(Continued)

(58) Field of Classification Search
CPC ..... A63B 69/0071; A63B 24/0021; A63B 63/083; A63B 69/40; A63B 71/0605;
(Continued)

(56) References Cited

U.S. PATENT DOCUMENTS 435,964 A 9/1890 Compton
1,223,386 A 4/1917 Handelan
(Continued)

FOREIGN PATENT DOCUMENTS

CN 303127130 3/2015
CN 303207615 5/2015
(Continued)

OTHER PUBLICATIONS

Airborne Athletics, Inc., www.imakebasketball.com/training_features.html, Jun. 2008, visited Feb. 3, 2016 via http://web.archive.org/web/20080608033916/http://www.imakebasketball.com/training_features.html.

(Continued)

*Primary Examiner* — Jeffrey S Vanderveen
(74) *Attorney, Agent, or Firm* — Standley Law Group LLP; Jeffrey S. Standley; Adam J. Smith

(57) ABSTRACT

Systems and methods for detecting made and missed basketball shots are provided. A launcher passes basketballs to shooting locations about a basketball playing area based on user input provided at an interface to define a custom practice arrangement. A camera captures images of an underside of a rim of a basketball goal. A controller receives images from the camera, associates the images with passes from the launcher, processes the images using a machine vision model to determine which of said received images indicate a made shot, and generates a performance report indicating a number or percentage of made shots for each location in the custom practice arrangement.

21 Claims, 9 Drawing Sheets

(51) Int. Cl.
*A63B 63/08* (2006.01)
*A63B 71/06* (2006.01)
*A63B 24/00* (2006.01)

(52) U.S. Cl.
CPC ..... *A63B 69/40* (2013.01); *A63B 71/0605* (2013.01); *A63B 2024/0028* (2013.01); *A63B 2024/0037* (2013.01); *A63B 2210/50* (2013.01); *A63B 2220/05* (2013.01); *A63B 2220/807* (2013.01); *A63B 2220/833* (2013.01); *A63B 2225/093* (2013.01); *A63B 2243/0037* (2013.01)

(58) Field of Classification Search
CPC .... A63B 2024/0028; A63B 2024/0037; A63B 2210/50; A63B 2220/05; A63B 2220/807; A63B 2220/833; A63B 2225/093; A63B 2243/0037
See application file for complete search history.

(56) References Cited

U.S. PATENT DOCUMENTS

D174,027 S 2/1955 Farkas
2,908,266 A 10/1959 Cooper
D204,309 S 4/1966 Murray
3,776,550 A 12/1973 McNabb
3,802,703 A 4/1974 Van Tassel
3,878,828 A 4/1975 Francesco
4,168,695 A 9/1979 Haller et al.
4,262,648 A 4/1981 Wegener et al.
4,269,163 A 5/1981 Feith
4,471,746 A 9/1984 Ando
4,579,340 A 4/1986 Jenkins et al.
D287,854 S 1/1987 Crews
4,667,957 A 5/1987 Joseph
4,678,189 A 7/1987 Koss
4,714,248 A 12/1987 Koss
4,717,149 A 1/1988 Juhl
4,913,431 A 4/1990 Jakobs
4,936,577 A 6/1990 Kington et al.
4,940,231 A 7/1990 Ehler
4,955,605 A 9/1990 Goldfarb
5,016,875 A 5/1991 Joseph
5,039,977 A 8/1991 Mele et al.
5,125,651 A 6/1992 Keeling et al.
5,312,099 A 5/1994 Oliver, Sr.
5,342,041 A 8/1994 Aguinek et al.
5,365,427 A 11/1994 Soignet et al.
5,393,049 A 2/1995 Nelson
5,409,211 A 4/1995 Adamek
5,417,196 A 5/1995 Morrison et al.
5,450,540 A 9/1995 Spohrer et al.
5,540,428 A 7/1996 Joseph
5,647,747 A 7/1997 Macri et al.
5,676,120 A 10/1997 Joseph
5,681,230 A 10/1997 Krings
5,746,668 A 5/1998 Ochs
5,768,151 A 6/1998 Lowy et al.
5,776,018 A 7/1998 Simpson et al.
5,813,926 A 9/1998 Vance
5,816,953 A 10/1998 Cleveland
5,842,699 A 12/1998 Mirando et al.
6,224,503 B1 5/2001 Joseph
6,241,628 B1 6/2001 Jenkins
D445,426 S 7/2001 Wang et al.
6,389,368 B1 5/2002 Hampton
6,659,893 B1 12/2003 Campbell et al.
6,707,487 B1 3/2004 Aman et al.
6,731,316 B2 5/2004 Herigstad et al.
6,746,397 B2 6/2004 Lee et al.
6,918,591 B2 7/2005 D'Amico et al.
7,094,164 B2 8/2006 Marty et al.
D554,661 S 11/2007 Hoover et al.
D554,662 S 11/2007 Hoover et al.
D591,305 S 4/2009 Shimoda
7,620,466 B2 11/2009 Neale et al.
7,850,552 B2 12/2010 Marty et al.
7,854,669 B2 12/2010 Marty et al.
7,927,237 B2 4/2011 Jenkins et al.
D637,199 S 5/2011 Brinda et al.
7,938,746 B2 5/2011 Chipperfield
8,012,046 B2 9/2011 Campbell et al.
8,016,687 B2 9/2011 Martin et al.
8,123,634 B1 2/2012 Lovett
8,147,356 B2 4/2012 Campbell et al.
8,206,246 B2 6/2012 Joseph et al.
8,408,982 B2 4/2013 Marty et al.
8,409,024 B2 4/2013 Marty et al.
D681,662 S 5/2013 Fletcher et al.
D687,845 S 8/2013 Lee
8,540,560 B2 9/2013 Crowley et al.
D690,728 S 10/2013 Brinda
8,579,632 B2 11/2013 Crowley
8,617,008 B2 12/2013 Marty et al.
8,622,832 B2 1/2014 Marty et al.
D704,734 S 5/2014 Wafapoor
8,727,784 B1 5/2014 Wolf
D714,321 S 9/2014 Pereira
D714,325 S 9/2014 Pereira
8,852,030 B2 10/2014 Campbell et al.
8,854,457 B2 10/2014 De Vleeschouwer et al.
8,908,922 B2 12/2014 Marty et al.
8,948,457 B2 2/2015 Marty et al.
9,010,309 B2 4/2015 Lewis et al.
9,015,627 B2 4/2015 Lal
9,017,188 B2 4/2015 Joseph et al.
D737,278 S 8/2015 Shin et al.
D739,488 S 9/2015 Campbell et al.
D745,533 S 12/2015 Luo
D746,855 S 1/2016 Choi
9,233,292 B2 1/2016 Joseph et al.
9,238,165 B2 1/2016 Marty et al.
9,248,368 B2 2/2016 Stimac
9,254,432 B2 2/2016 Ianni et al.
9,283,431 B2 3/2016 Marty et al.
9,283,432 B2 3/2016 Marty et al.
9,345,929 B2 5/2016 Marty et al.
9,358,455 B2 6/2016 Marty et al.
9,370,704 B2 6/2016 Marty
D760,769 S 7/2016 Ishii et al.
D761,840 S 7/2016 Patterson et al.
9,390,501 B2 7/2016 Marty et al.
D762,709 S 8/2016 Hsieh
D767,596 S 9/2016 Shi
9,452,339 B1 9/2016 Shah et al.
D768,143 S 10/2016 Drozd et al.
D768,148 S 10/2016 Jung et al.
9,474,953 B1 10/2016 Duke
D774,518 S 12/2016 Lv
D776,676 S 1/2017 Shi
D778,314 S 2/2017 Li et al.
D783,659 S 4/2017 Park
D786,269 S 5/2017 Lin et al.
D789,393 S 6/2017 Jaini et al.
D790,585 S 6/2017 Kim et al.
9,687,713 B1 6/2017 Duke
D791,786 S 7/2017 Chauhri et al.
9,694,238 B2 7/2017 Marty et al.
9,697,617 B2 7/2017 Marty et al.
9,724,584 B1 8/2017 Campbell et al.
9,734,405 B2 8/2017 Marty et al.
9,808,696 B2 11/2017 Campbell et al.
D808,976 S 1/2018 Shi
9,886,624 B1 2/2018 Marty et al.
9,914,035 B2 3/2018 Campbell et al.
D817,348 S 5/2018 Ishikawa et al.
D818,488 S 5/2018 Frazier
9,975,026 B2 5/2018 Campbell et al.
10,004,949 B2 6/2018 Brothers et al.
10,010,778 B2 7/2018 Marty et al.
D824,955 S 8/2018 Lee et al.
10,092,793 B1 10/2018 Marty et al.
D838,729 S 1/2019 Guerrieri et al.

(56) References Cited

U.S. PATENT DOCUMENTS

| | | | | |
|---|---|---|---|---|
| 10,252,133 | B2 | 4/2019 | Campbell et al. | |
| 10,315,090 | B2 | 6/2019 | Campbell et al. | |
| 10,343,015 | B2 | 7/2019 | Marty et al. | |
| 10,360,685 | B2 | 7/2019 | Marty et al. | |
| D861,720 | S | 10/2019 | Koller et al. | |
| 10,471,325 | B2 | 11/2019 | Marty et al. | |
| 10,537,780 | B2 | 1/2020 | Joseph et al. | |
| 10,561,916 | B1 | 2/2020 | Campbell et al. | |
| 10,596,436 | B1 * | 3/2020 | Campbell | A63B 69/0071 |
| 10,610,757 | B1 | 4/2020 | Marty | |
| 10,688,362 | B1 * | 6/2020 | Sangalang | A63B 71/0622 |
| 10,762,642 | B2 | 9/2020 | Marty et al. | |
| 2002/0010032 | A1 | 1/2002 | Stiteler | |
| 2003/0023145 | A1 | 1/2003 | Lee et al. | |
| 2005/0143154 | A1 | 6/2005 | Bush | |
| 2006/0068945 | A1 | 3/2006 | Murchison, III | |
| 2006/0160639 | A1 | 7/2006 | Klein | |
| 2006/0236993 | A1 | 10/2006 | Cucjen et al. | |
| 2007/0026974 | A1 | 2/2007 | Marty et al. | |
| 2007/0026975 | A1 | 2/2007 | Marty et al. | |
| 2007/0173355 | A1 | 7/2007 | Klein | |
| 2007/0265138 | A1 | 11/2007 | Ashby | |
| 2008/0015061 | A1 | 1/2008 | Klein | |
| 2008/0200287 | A1 | 8/2008 | Marty et al. | |
| 2008/0254866 | A1 | 10/2008 | Young et al. | |
| 2008/0261726 | A1 | 10/2008 | Chipperfield | |
| 2008/0312010 | A1 | 12/2008 | Marty et al. | |
| 2009/0042672 | A1 | 2/2009 | Radice | |
| 2009/0045578 | A1 | 2/2009 | Wang | |
| 2009/0137347 | A1 * | 5/2009 | Jenkins | A63B 69/0071 473/433 |
| 2010/0259412 | A1 | 10/2010 | Pagonakis | |
| 2010/0261557 | A1 | 10/2010 | Joseph et al. | |
| 2011/0013087 | A1 | 1/2011 | House et al. | |
| 2011/0071818 | A1 | 3/2011 | Jiang | |
| 2011/0294585 | A1 | 12/2011 | Penna et al. | |
| 2012/0115651 | A1 | 5/2012 | Chipperfield | |
| 2013/0095959 | A1 | 4/2013 | Marty et al. | |
| 2013/0130845 | A1 | 5/2013 | Marty et al. | |
| 2013/0172058 | A1 | 7/2013 | Marty et al. | |
| 2014/0092253 | A1 | 4/2014 | Marty et al. | |
| 2014/0135956 | A1 | 5/2014 | Thurman et al. | |
| 2014/0195022 | A1 | 7/2014 | Thurman et al. | |
| 2014/0200692 | A1 | 7/2014 | Thurman et al. | |
| 2014/0222177 | A1 * | 8/2014 | Thurman | A63B 41/02 700/92 |
| 2014/0283142 | A1 | 9/2014 | Shepherd et al. | |
| 2014/0301601 | A1 | 10/2014 | Marty et al. | |
| 2015/0028541 | A1 | 1/2015 | Murakami et al. | |
| 2015/0141144 | A1 | 5/2015 | Sprague et al. | |
| 2015/0258416 | A1 | 9/2015 | Ianni et al. | |
| 2015/0265897 | A1 | 9/2015 | Gordon et al. | |
| 2015/0290516 | A1 | 10/2015 | Joseph et al. | |
| 2016/0082340 | A1 | 3/2016 | Adams | |
| 2016/0121193 | A1 | 5/2016 | Marty et al. | |
| 2016/0166907 | A1 | 6/2016 | Joseph et al. | |
| 2016/0193518 | A1 | 7/2016 | Baxter et al. | |
| 2016/0250540 | A1 | 9/2016 | Joseph et al. | |
| 2016/0287964 | A1 | 10/2016 | Jones | |
| 2016/0310814 | A1 | 10/2016 | Joseph et al. | |
| 2016/0325168 | A1 | 11/2016 | Campbell et al. | |
| 2016/0354664 | A1 | 12/2016 | De Carlo | |
| 2017/0007921 | A1 | 1/2017 | Baba et al. | |
| 2017/0136333 | A1 | 5/2017 | Joseph et al. | |
| 2017/0157482 | A1 | 6/2017 | DeCarlo | |
| 2017/0161561 | A1 | 6/2017 | Marty et al. | |
| 2017/0232298 | A1 | 8/2017 | Joseph et al. | |
| 2017/0282044 | A1 | 10/2017 | Moore et al. | |
| 2017/0340949 | A1 | 11/2017 | Tsai | |
| 2018/0056124 | A1 | 3/2018 | Marty et al. | |
| 2018/0322337 | A1 | 11/2018 | Marty et al. | |
| 2019/0329114 | A1 | 10/2019 | Marty et al. | |
| 2020/0098113 | A1 | 3/2020 | Marty et al. | |
| 2020/0364462 | A1 * | 11/2020 | Imes | H04N 5/23219 |

FOREIGN PATENT DOCUMENTS

| | | | |
|---|---|---|---|
| EP | 2271414 | B1 | 6/2014 |
| RU | 2026104 | | 1/1995 |
| WO | 9530872 | A1 | 11/1995 |
| WO | 9532033 | | 11/1995 |
| WO | 2005062841 | | 7/2005 |
| WO | 2009126982 | A2 | 10/2009 |

OTHER PUBLICATIONS

Airborne Athletics, Inc., www.airborneathletics.com/imake-basketball-machine.php, Feb. 2011, visited Feb. 3, 2016 via http://web.archive.org/web/20110213020947http://www.airborneathletics.com/imake-basketball-machine.php.

Airborne Athletics, Inc., www.drdishbasketball.com, visited Mar. 1, 2016.

Airborne Athletics, Inc., Dr. Dish Display, Available Apr. 2015.

Control Panel shown on webpage: https://web.archive.org/web/20131011040129/https://www.winners-choice.net/gun-8000.html, Web Archive Capture date: Oct. 11, 2013 [acessed on Feb. 24, 2018] (Year: 2013).

Shoot-A-Way, Inc., www.shootaway.com, visited Mar. 1, 2016.

The Gun 6000 Series, Shoot-A-Way, Inc. Upper Sandusky, Ohio, http://www.shootaway.com/Gun1.htm/, at least as early as Jun. 2000.

Dr. Dish™, Airborne Athletics Inc., Belle Plaine, Minnesota, http://www.drdishbasketball.com/, at least as early as Jul. 29, 2003.

IMake™, Airborne Athletics Inc., Belle Plaine, Minnesota, www.imakebasketball.com. (The iMake has a menu drive programming board allowing the user to select a shooting range by selecting a left and a right limit. The user is given the ability to select spots between said shooting range in spaced increments for the machine to fire balls in that direction. ) At least as early as Jun. 2008.

Vorelco, The Sniper Basketball Training System, https://www.youtube.com/watch?v=X9SqMy8xdf4, Uploaded on Jul. 5, 2008.

Brochure entitled "Sniper: The Ultimate Basketball Trainer." before Oct. 22, 1995, 5 pages including the cover letter.

Dr. Dish Owner's Manual, Airborne Athletics, Inc., 2005.

Reich, B. et al., A Spatial Analysis of Basketball Shot Chart Data, The American Statistician, Feb. 2006, vol. 60 No. 1.

Sniper, First Advanced Basketball Training Device, 2009.

BSN Sports, Hot Shot Basketball Shooting Machine, https://www.bsnsports.com/hot-shot-basketball-shooting-machine, site accessed Mar. 9, 2021.

MYOM, MYOM Basketball Shooting Gun Basketball Rebounder Machine—Best Basketball Shooting Trainer, https://www.amazon.com/MYOM-Basketball-Shooting-Rebounder-Machine/dp/B07HBN5X81, site accessed Mar. 9, 2021.

SIBOASI, Basketball Passing Machine S6839, https://www.siboasi.com/basketball-passing-machine-s6839.html, site accessed Mar. 9, 2021.

SIBOASI, SIBOASI S6839 Programmable Basketball Shooting Machine, https://www.youtube.com/watch?v=ZjzTnaLOccY&t=16s, Jun. 1, 2019.

ECoach, Learn From the Best Minds in Basketball and Grow Your Game, https://ecoachsports.com/basketball-old/, site accessed Aug. 28, 2019.

Sideline Scout, Sideline Live, https://sidelinescout.com/sports/basketball/, site accessed Aug. 28, 2019.

White, J., Technology Grows and Coaches Need to Grow With [it]: Remote Training Gives High School Athletes a Different Outlet, USA Today High School Sports, https://usatodayhss.com/2019/technology-grows-and-coaches-need-to-grow-with-it-remote-training-gives-high-school-athletes-a-different-outlet, Jul. 4, 2019.

HomeCourt, https://www.homecourt.ai/, site accessed Aug. 28, 2019.

* cited by examiner

BASKETBALL LAUNCHING DEVICE WITH A CAMERA FOR DETECTING MADE SHOTS

CROSS-REFERENCE TO RELATED APPLICATIONS

This application claims the benefit of U.S. Provisional Patent Application No. 62/858,524 filed Jun. 7, 2019, the disclosures of which are hereby incorporated by reference as if fully rested herein.

TECHNICAL FIELD

Exemplary embodiments relate generally to systems and methods for a basketball launching device with a camera for detecting shots passing through the rim of a basketball goal.

BACKGROUND AND SUMMARY OF THE INVENTION

Basketball return machines exist which assist a basketball player by returning made shots, and usually at least some missed shots, to the player such that the player does not have to spend time retrieving the basketballs. This way, the player is able to fit more shots into a given practice session. Some basketball return machines use a guide or track to direct basketballs towards a player. Other basketball return machines use launching devices to eject basketballs in various directions on a playing area. Exemplary basketball return machines include, without limitation, THE GUN machines available from Shoot-A-Way, Inc. of Upper Sandusky, Ohio (shootaway.com/) and DR. DISH machines available from Airborne Athletics, Inc. of Minneapolis, Minn. (www.drdishbasketball.com/).

In order to provide the player with feedback regarding his or her shooting performance during a given practice session, detection devices are sometimes used to monitor the player's performance. Such detection devices may take the form of flappers which are placed along the route a basketball would take during or after passing through the rim and are physically moved or contacted when a basketball moves along such a route, thus indicating a successfully made shot. Such devices are subject to physical wear, jamming, and may disrupt the basketball's travel. Other exemplary detection devices include photo-eyes. Such photo-eyes may be mounted in close proximity to a basketball hoop and monitor for changes in the ambient light created when a basketball passes through the hoop. Such photo-eyes are subject to inaccurate readings due to changes in ambient lighting conditions which may be caused, for example, by the net shifting in front of the photo-eye, reflections, flash photographs, or lights being turned on or off. Additionally, all of the above detection devices may be difficult to appropriately position in relation to the basketball goal. What is needed is a basketball launching device with a camera for detecting made shots.

A basketball launching device with a camera for detecting made shots is provided. The basketball launching device may comprise an interface for selecting shooting locations on a playing area where basketballs will be ejected for a player to receive and shoot towards a basketball goal. The interface may comprise a rendering of a basketball playing area. The interface may be configured to receive a user's selection of one or more of a number of selectable areas on the rendering where the selectable areas are positioned to correspond with actual locations on the playing area so that the player knows where to stand to receive the ejected passes.

The camera may be mounted on the basketball launching device and may be positioned to capture images of the underside of the rim. The camera may be configured to capture images as basketballs are shot by a player towards the basketball goal. The camera may feed the captured images to a controller. The controller may comprise a machine learning model configured to determine if no basketball is detected within the image, a basketball is detected but has not passed through the rim, or a basketball is detected that has passed through the rim. A made shot may be determined where captured images are received with a basketball in the frame which has passed through the rim. Otherwise, a missed shot may be recorded. The machine learning model may comprise a neural network trained from a large dataset of images. The controller may record a made shot or a missed shot as determined by the model.

A performance report may be generated comprising percentages of successfully made shots for each shooting location the basketballs were ejected. The performance report may comprise a rendering which may substantially match the rendering on the interface. The percentages of successfully made shots may be provided on the rendering of the performance report at the shooting locations the basketballs were ejected to so that a user can quickly assess their areas of strength and weakness.

Further features and advantages of the systems and methods disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Figure 1:
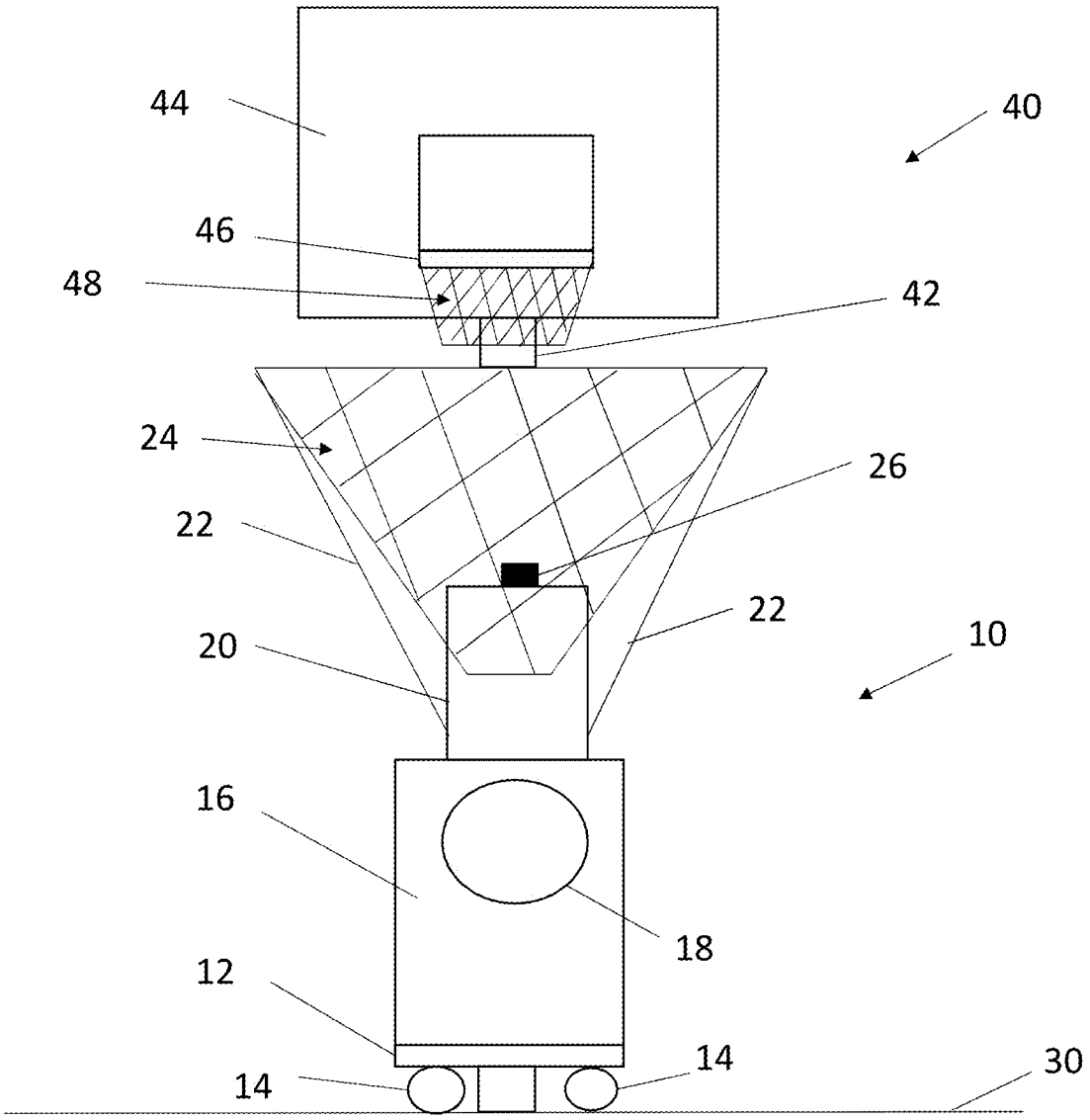
FIG. 1 is a front view of an exemplary basketball launching device having a camera-based detection system in accordance with the present invention located near a basketball goal on a playing area.
Figure 2:
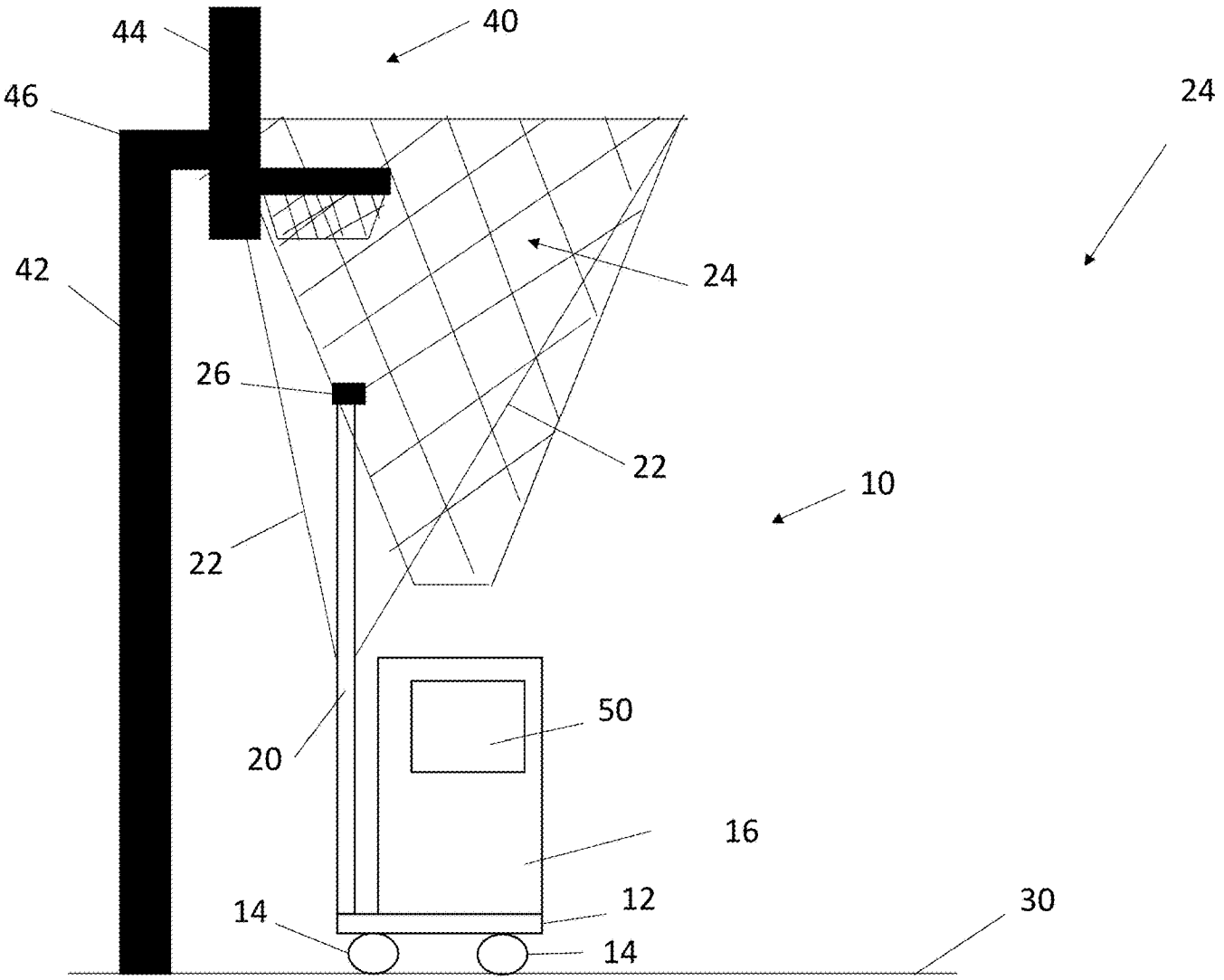
FIG. 2 is a side view of the FIG. 1 device.

FIG. 1 is a front view of an exemplary basketball launching device 10 and FIG. 2 is a side view of the basketball launching device 10. The basketball launching device 10 may comprise a platform 12. A number of wheels 14 may be mounted to the platform which permit movement of the platform around a playing area 30. A housing 16 may be mounted to the platform 12. The housing 16, in exemplary embodiments, may be mounted to the platform 12 in a rotatable manner. An aperture 18 may be located in the housing 16. The aperture 18 may be sized to permit basketballs 60 to be ejected therethrough to various locations on the playing area 30. In other exemplary embodiments, the housing 16 is not required or is provided outside the travel path of the basketball.

A frame 20 may extend vertically from the platform 12. A number of support members 22 may be attached to said frame 20. At least some of said support members 22 may be adjustable in length. In exemplary embodiments, at least some of the support members 22 may comprise telescoping poles. In exemplary embodiments, four support members 22 may extend upwardly and outwardly from the frame 20 in a splayed fashion, though any number and configuration of support members 22 may be utilized.

A net 24 may be attached to one or more of the support members 22. Openings in the net 24 may be sized to prevent the basketballs 60 from passing therethrough. The net 24 may be configured to create a funnel shape when mounted to said support members 22 such that basketballs 60 gathered in the net 24 are directed towards the housing 16 where they may be received through one or more openings. However, any size, shape, and type of net 24 may be utilized. Alternatively, or in addition, one or more guide tracks may extend between the bottom of the net 24 and the housing 16.

The basketball launching device 10 may be placed in proximity to a basketball goal 40 by a user. The basketball goal 40 may be regulation type, height, size and configuration, though such is not required. The basketball goal 40 may comprise a post 42 which extends to the playing area 30, a backboard 44, a rim 46, and a net 48, for example without limitation. For example, without limitation, the rim 46 may be positioned 10 feet above the playing area 30.

The frame 20 may be adjustable. For example, without limitation, the frame 20 may comprise one or more mechanisms for collapsing the support members 22, the net 24, and/or the frame 20 itself. In this way, the basketball launching device 10 may be selectively reduced in size. In exemplary embodiments, the basketball launching device 10 may be sufficiently reduced in size so as to fit through a standard size doorway, though such is not required. As another example, without limitation, the frame 20 may comprise one or more mechanisms for expanding the support members 22, the net 24, and/or the frame 20 itself. In this way, the basketball launching device 10 may be selectively increased in size. In exemplary embodiments, the basketball launching device 10 may be positioned and sufficiently increased in size such that one or more upper edges of the net 24 extend above the rim 46 of the basketball goal 40. When expanded, the net 24 may create a sufficiently sized top opening to accommodate most made shots as well as at least some missed shots, which are gathered by the net 24 and returned to the housing 16.

In still other exemplary embodiments, adjustment of the net 24 may be achieved by adjustment of the support members 22, with or without adjustment of the frame 20. FIG. 1 illustrates an exemplary configuration of the basketball launching device 10 with the net 24 positioned below the rim 46 and FIG. 2 illustrates an exemplary configuration of the basketball launching device 10 with the net 24 positioned above the rim 46 of the basketball goal 40. Any height of the net 24 in a collapsed and/or expanded position may be utilized.

At least one camera(s) 26 may be mounted to the basketball launching device 10. In exemplary embodiments, the camera(s) 26 may be mounted to the frame 20. For example, without limitation, the camera(s) 26 may be mounted to an upper portion of the frame 20. The camera(s) 26 may be positioned to face upwardly, or at an upward angle. In this way, the camera(s) 26 may be located and oriented to capture a view of the underside of the rim 46 of the basketball goal 40 when the basketball launching device 10 is placed in proximity to the basketball goal 40. However, any location of the camera(s) 26 may be utilized. The camera(s) 26 may, for example without limitation, be mounted on one or more members which extend through the net 24. In other exemplary embodiments, the camera(s) 26 may be positioned on a portion of the frame 20 outside of the net 24. Regardless, the camera(s) 26 may be configured to capture images of rim 46 and any basketballs 60 passing therethrough. Stated another way, the camera(s) 26 may be configured to capture images of made shots.

The camera(s) 26 may be mounted to the frame 20 in an adjustable fashion. The camera(s) 26 may be mounted to the frame 20 in a detachable fashion. In other exemplary embodiments, the camera(s) 26 may be permanently affixed to the frame 20.

An interface 50 may be connected to the frame 20. In exemplary embodiments, the interface 50 may be mounted to the housing 16. Any size, shape, or location of the interface 50 may be utilized. Alternatively, or additionally, the interface 50 may be provided on one or more personal electronic devices 70 such as, but not limited to, a smartphone, a tablet, a personal computer, some combination thereof, or the like.

Figure 3:
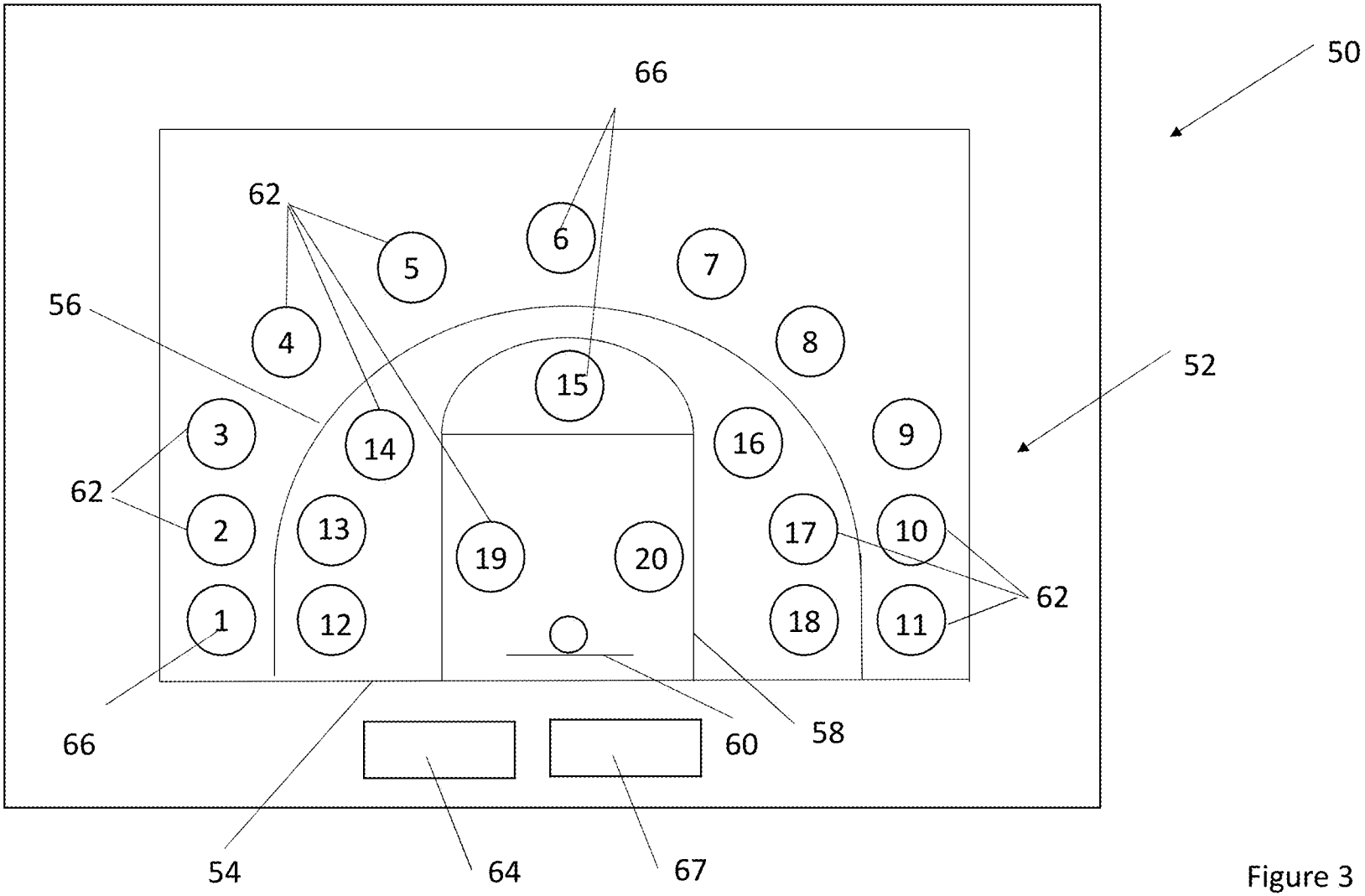
FIG. 3 is a detailed view of an exemplary interface of the FIG. 2 device with an exemplary location selection display.

FIG. 3 is a detailed view of the interface 50 with an exemplary location selection display. The interface 50 may comprise a rendering 52 of a basketball court, such as but not limited to, the playing area 30. The rendering 52 may comprise, for example without limitation, a rendering of a baseline 54, a key 58, a three-point arc 56, a basketball goal 60, some combination thereof, or the like. Any size, shape, arrangement, or components of the rendering 52 on the interface 50 may be utilized.

The interface 50 may comprise a number of selectable areas 62. The selectable areas 62 may be located at various positions on the rendering 52 to correlate with shooting positions on the playing area 30. The selectable areas 62 may be selected by the user to create custom shooting arrangements.

In exemplary embodiments, the interface 50 may comprise a touch screen. In such embodiments, the rendering 52 may be electronically generated on the touch screen. The selectable areas 62, in such embodiments, may already be visible on the interface 50 and may change when selected. In other such embodiments, the selectable area 62 may not be visible and may become visible when the corresponding area of the interface 50 is selected. Such selection may be performed by direct, individual, physical contact, though such is not required. The touch screen may comprise a resistive, capacitive, or other type of touch screen.

In other exemplary embodiments, the interface 50 may comprise an electronic display. In such embodiments, the rendering 52 may be electronically generated on the electronic display. The selectable areas 62, in such embodiments, may already be visible on the interface 50 and may change when selected. Such selection may be performed by one or more selection devices 64. Such selection devices 64 may permit interaction with the images displayed on the electronic display. For example, without limitation, such selection devices 64 may comprise a keypad, mouse, buttons, arrows, some combination thereof, or the like. The electronic display may comprise an LCD, cathode ray, OLED, plasma, or other type of electronic display.

In still other exemplary embodiments, the interface 50 may comprise a static panel. In such embodiments, the rendering 52 may be painted, printed, integrally formed, or otherwise displayed on the interface 50 in a permanent or semi-permanent fashion. The selectable areas 62, in such embodiments, may comprise buttons. The selectable areas 62 may comprise illumination devices or the like which are configured to indicate whether the selectable areas 62 have been selected by a user. Such selection may be performed by direct, individual, physical contact, though such is not required.

The selectable areas 62 may be provided at various locations on the rendering 52. The selectable areas 62 may be circular in shape, though any size and shape selectable areas 62 may be utilized. The selectable areas 62 may be located at spaced angular positions along the rendering 52. For example, without limitation, a number of selectable areas 62 may be positioned on or along the rendering of the three-point arc 56. In exemplary embodiments, some of the selectable areas 62 may be located inside the three-point arc 56 and other selectable areas 62 may be located outside of the three-point arc 56, though such is not required. Alternatively, or in addition, some or all of the selectable areas 62 may be located within or around the rendering of the key 58. Any size, shape, number, or arrangement of selectable areas 62 may be utilized.

Each of the selectable areas 62 may comprise one or more markers 66. The markers 66 may be numbers, letter, symbols, some combination thereof or the like. The markers 66 may provide nomenclature for the selectable areas 62 as well as the corresponding shooting positions on the playing area. The interface 50 may be configured to monitor for, and/or receive, a user selection of one or more of the selectable areas 62 to create a custom basketball practice arrangement. The selectable areas 62 may be individually selected by physical touch. The selectable areas 62 may form input locations for receiving user input.

Alternative or in addition to the embodiments described herein, a number of predetermined sets of selectable areas 62 may be preprogrammed to define pre-made practice arrangement. Such pre-made practice arrangements may be made available by way of certain ones of said selectable areas 62. In such embodiments, the interface 50 may be configured to permit the user to select one or more such predetermined programs as an alternative to, or in addition to, creating a custom practice arrangement.

The interface 50 may comprise an area 67 for selecting additional options such as, but not limited to, time delay between passes, number of basketballs per location, and the like. In exemplary embodiments, the separate area 67 may not be required and such options may be selected at the area with the rendering 52.

Figure 3B:
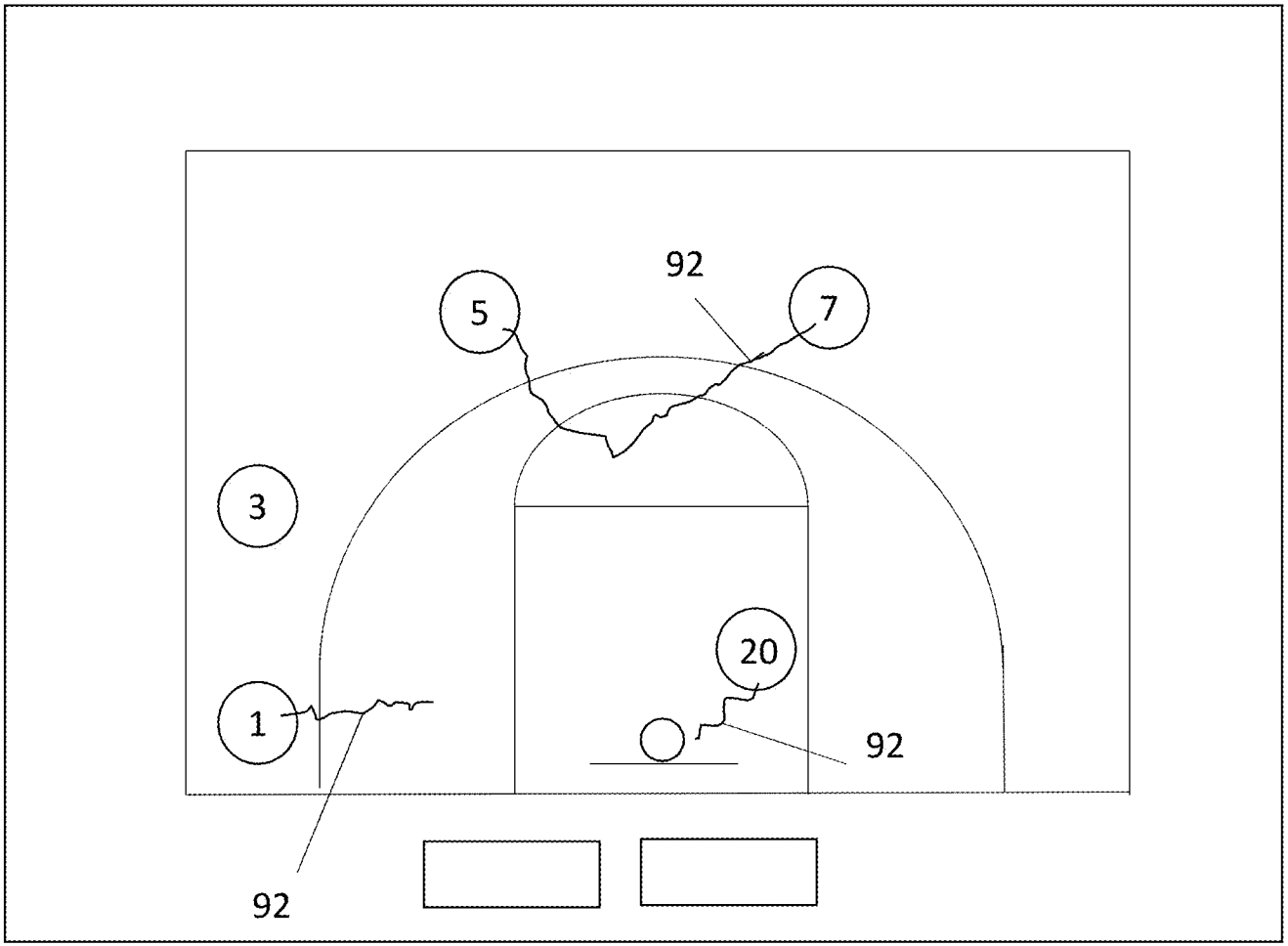
FIG. 3B is a detailed view of the interface of FIG. 3 with an exemplary player path display.

FIG. 3B is a detailed view of the interface 50 with an exemplary player path display. In some exemplary embodiments, the interface 50 may be configured to display travel paths 92 for a player 72. The travel paths 92, for example without limitation, may comprise displayed as straight lines, squiggle lines, color coded, or the like. The travel paths 92 may convey instructions to the player 72 on locations to run to between passes. The travel paths 92 may comprise out-and-back paths, such as the travel path 92 shown from shooting location 1 in the illustrated embodiment. The travel paths 92 may comprise shooting paths, such as the travel path 92 shown from shooting location 20 in the illustrated embodiment, which may indicate that the player 72 should perform a layup shot. The travel paths 92 may comprise routes between shooting locations, such as the travel path 92 between shooting locations 5 and 7 in the illustrated embodiment. Of course, the illustrated embodiment is merely exemplary and is not intended to be limiting. Any number or type of travel paths 92 between any number of locations may be utilized. Likewise, any way of representing the travel paths 92 may be utilized.

Figure 4:
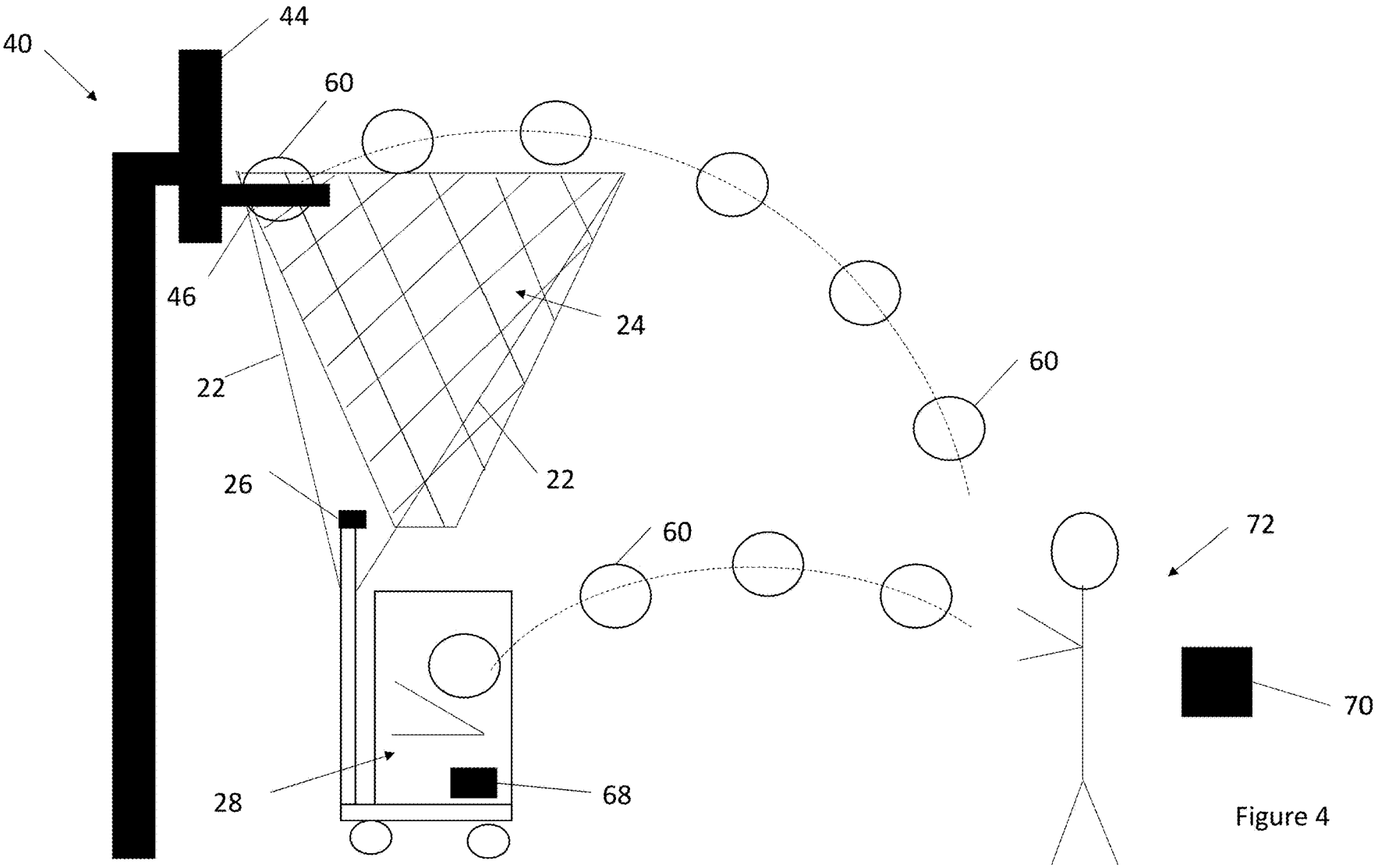
FIG. 4 is a side view of the FIG. 1 device with certain elements of the basketball launching device removed to illustrate additional components, exemplary basketballs paths are also illustrated.

FIG. 4 is a side view of the basketball launching device 10 with certain elements of the housing 16 removed to illustrate the launcher 28. The launcher 28 may be configured to launch one or more basketballs 60 to one or more shooting locations on the playing area 30 for a player 72 to catch and shoot towards the basketball goal 40. For example, without limitation, the launching device 28 may comprise a catapult arm, thrower, wheeled device, some combination thereof, or the like. Any kind or type of launching device 28 may be utilized. The launcher 28 may be mounted to the housing 16 and/or the platform 12 in a rotatable manner, though such is not required.

The interface 50 may be placed in electronic communication with a controller 68. The controller 68 may be located in the housing 16, though any location of the controller 68 may be utilized. The controller 68 may comprise one or more electronic storage devices with executable software instructions and one or more processors. Alternatively, or in addition, the controller 68 may be part of one or more other components of the basketball launching device 10 including but not limited to, the camera(s) 26 and the interface 50. The controller 68 may be configured to receive electronic signals from the interface 50 regarding the user's selection of the selectable areas 62 to form a custom practice arrangement and may program the launcher 28 to pass basketballs 60 to each of the shooting locations on the playing area 30 corresponding to each of selectable areas 62 selected by the user at the interface 50 to perform the custom practice arrangement. The controller 68 may be configured to, alternatively or additionally, receive input from the interface 50 including user selection of the selection devices 64, area 67, pre-programmed drill, user preferences, other options, some combination thereof, or the like and program the launcher 28 in accordance with the received input.

The basketball launching device 10 may be positioned in proximity to the basketball goal 40 such that the basketballs 60 passing through the rim 46, and at least some of the basketballs 60 bouncing off the backboard 44 but not necessarily passing through the rim 46 or otherwise resulting in a missed shot (i.e., not passing through the rim 46), may be captured in the net 24. The camera(s) 26 may be positioned to face upwardly at the bottom of the rim 46. In this way, the camera(s) 26 may be configured to capture an image of the basketball rim 46 with no basketball (no ball in frame), an image of the basketball rim 46 and the basketball 60 failing to pass completely through the rim 46 (an attempted shot), or an image of the basketball 60 as it passes through the rim 46 (made shot).

Figure 5:
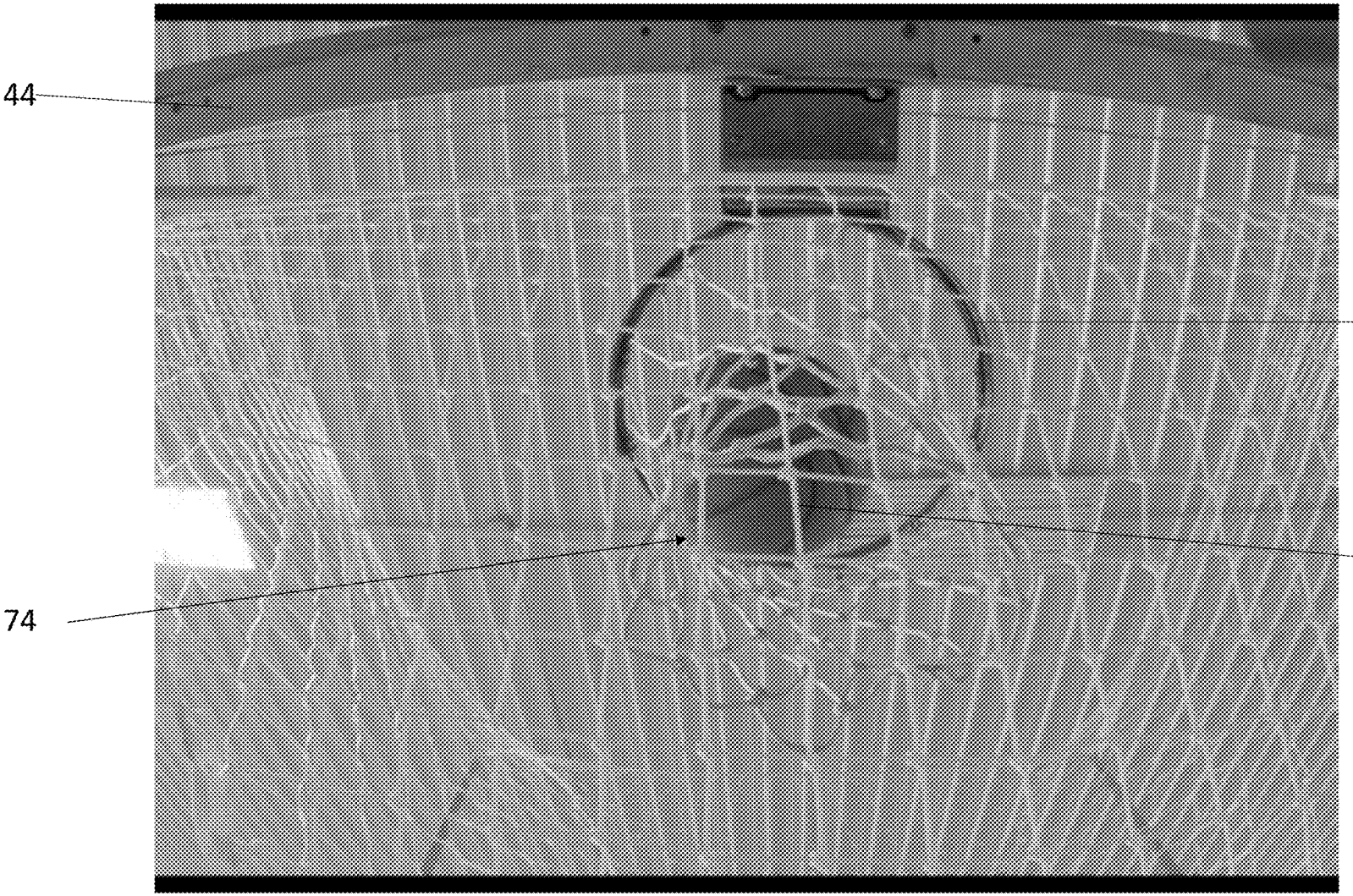
FIG. 5 is an exemplary image of a basketball passing through the hoop as seen by the camera of the FIG. 1 device.
Figure 6:
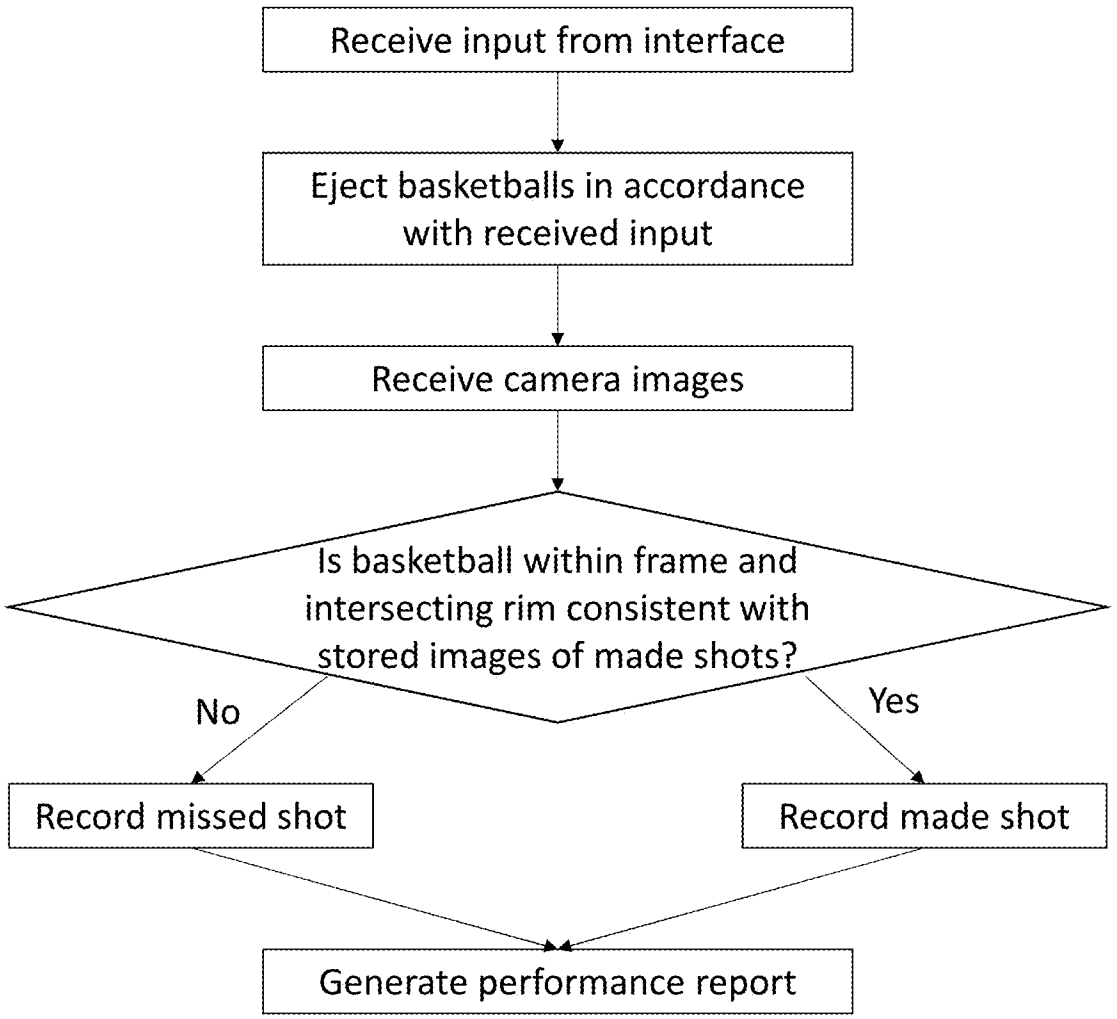
FIG. 6 is a flow chart with exemplary logic for operating the FIG. 1 device.

FIG. 5 is an exemplary image of a basketball 60 passing through the rim 46 as seen by the camera(s) 26—i.e., a made shot. FIG. 6 is exemplary logic for use with the controller 68. The camera(s) 26 may be placed in electronic communication with the controller 68. The controller 68 may be configured to receive one or more images from the camera(s) 26. Such images may comprise a video and/or one or more still images. The images may be captured continuously, periodically, at a specific time interval, sporadically, some combination thereof, or the like. In exemplary embodiments, the camera(s) 26 may be configured to capture approximately 36-40 frames per second. The camera(s) 26 may be configured to capture images following the ejection of a basketball 60 by the launcher 28. For example, without limitation, the camera(s) 26 may be activated immediately, or a period of time after, the launcher 28 ejects a basketball.

The controller 68 may comprise software instructions, which when executed, cause the controller 68 to receive the images from the camera(s) 26 and utilize machine learning software to determine whether or not the received image comprises a basketball 60, a basketball 60 not passing through the rim 46, or a basketball 60 passing through the rim 46.

The controller 68 may comprise a number of images of a rim 46 without a basketball 60, a number of images of a rim 46 and a basketball 60 not passing through the rim 46, and a number of images of a basketball 60 passing through the rim 46. In other exemplary embodiments, such images may be provided at one or more remote databases. The controller 68 may be configured to derive, or may be programmed with, software instructions, which may comprise one or more algorithms, configured to distinguish between images with a basketball 60, images without a basketball 60, images with a basketball 60 intersecting a rim 46, images with the basketball 60 intersecting a front portion of the rim 46, images with a basketball 60 located within the rim 46, images with a basketball 60 not intersecting the rim 46, images of the basketball 60 progressing through the rim 46, some combination thereof, or the like.

In exemplary embodiments, an attempted shot may be determined where images are received with no basketball 60 for a period of time following the ejection of a basketball 60 or images are received with a basketball 60 not passing completely through the rim 46. In exemplary embodiments, a made shot may be determined where images are received with a basketball 60 which passes completely through the rim 46. For example, without limitation, a basketball 60 may be determined to have completely passed through the rim 46 where the image of the basketball 60 is located within the rim 46 and/or is intersecting the front surface of the rim 46, as generally indicated at item 74. Alternatively, or in addition, the made shot may be confirmed by receipt of subsequent and/or further images showing a progression of the basketball 60 though the rim 46 in the manner and sequence consistent with a made shot. For example, without limitation, the machine learning software may be configured to search for images of a basketball 60 intersecting the rim 46, as generally indicated at item 74, in a fashion such that the basketball 60 progressively intersects more of the rim 46 for one or more frames before subsequently intersecting less of the rim 46 as is consistent with stored images of basketballs 60 passing through the rim 46.

It may be determined with a high degree of confidence that a given basketball 60 passed through the rim 46, and thus a basketball goal was successfully made, where the received image matches, or is within a predetermined margin of error of, the stored images of basketballs 60 passing completely through the rim 46. Similarly, it may be determined with a high degree of confidence that a given basketball 60 did not pass through the rim 46, and thus a basketball goal was not made, where the received image matches, or is within a predetermined margin of error of, the stored images of basketballs 60 not in the frame and/or not passing completely through the rim 46. Such determinations made be made continuously or periodically as basketballs 60 are launched and shots are taken, or may be performed after a given practice session is completed.

Figure 7:
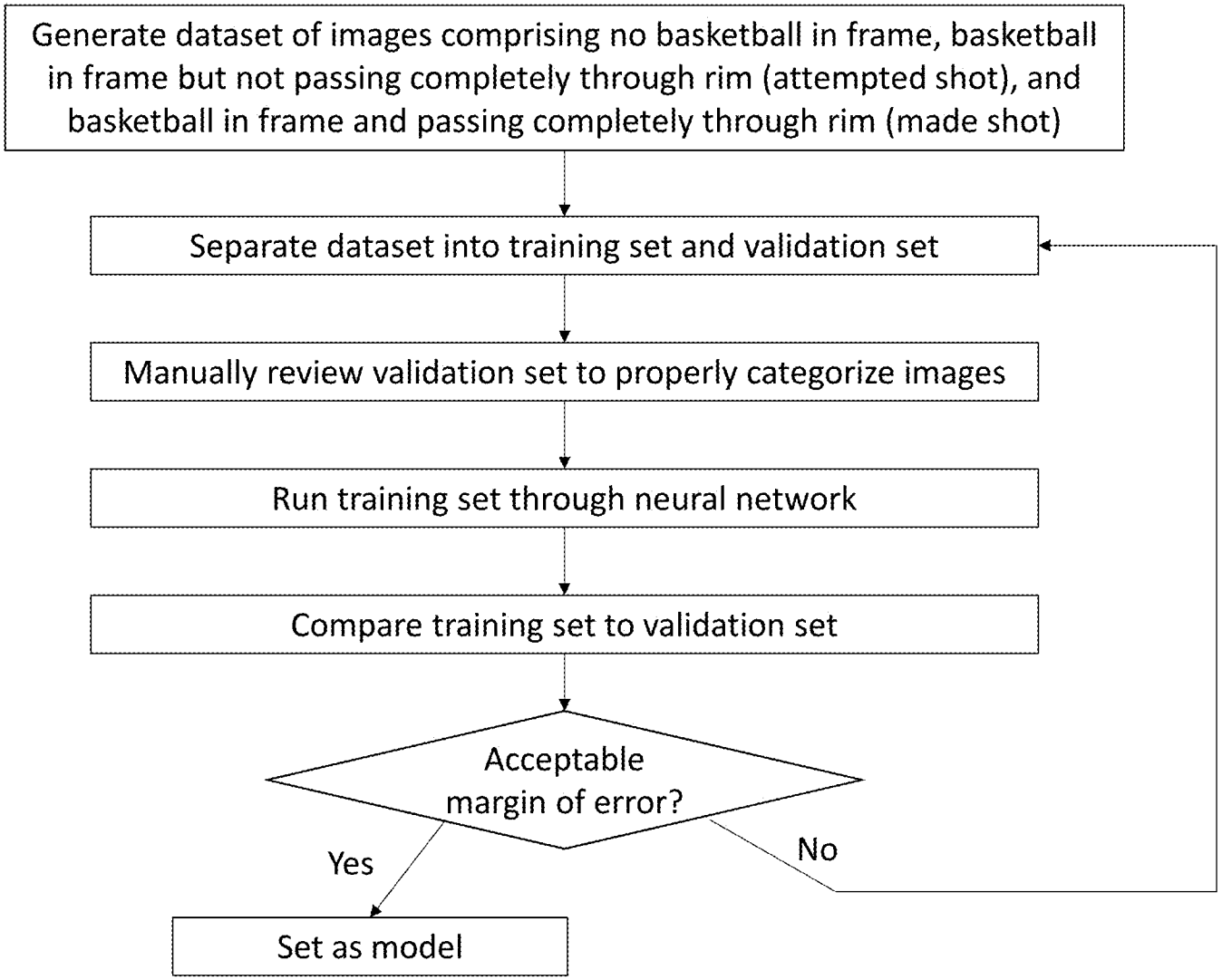
FIG. 7 is a flowchart of exemplary logic for creating a machine learning model for use with the device of FIG. 1.

FIG. 7 is a flowchart of exemplary logic for creating a machine learning model. In exemplary embodiments, a dataset comprising a number of images of a rim 46 without a basketball 60, a number of images of a rim 46 and basketballs 60 not passing completely thought through the rim 46, and a number of images of basketballs 60 passing completely through the rim 46 may be generated by taking a large number of such images. In exemplary embodiment, over 15,000 such images may be taken to form the dataset, though any number of images and any size dataset may be utilized. The images may be converted into a lossless format and may be resized as needed. A first subset of the images in the dataset may be separated for use as a training set. A second subset of the images in the dataset may be separated for use as a validation set. In exemplary embodiments, the first subset may comprise approximately 80% of the images and the second subset may comprise approximately 20% of the images. The first subset of images may be passed through a neural network to train the network to recognize each category of images. The second subset of images may be manually reviewed to properly categorize each image. The results of the first subset of images may be compared to the second subset, where the proper categorization is known, and the process may be repeated any number of times until the neural network is configured to categorize images with an acceptable degree of error to form a model. Once results within an acceptable threshold of accuracy is achieved, the neural network may be saved as a model. The model may then be utilized during actual practice sessions. The training may be performed off site and the model may be transferred to the controller 68. In other exemplary embodiments, the training may be performed at the controller 68.

Figure 8:
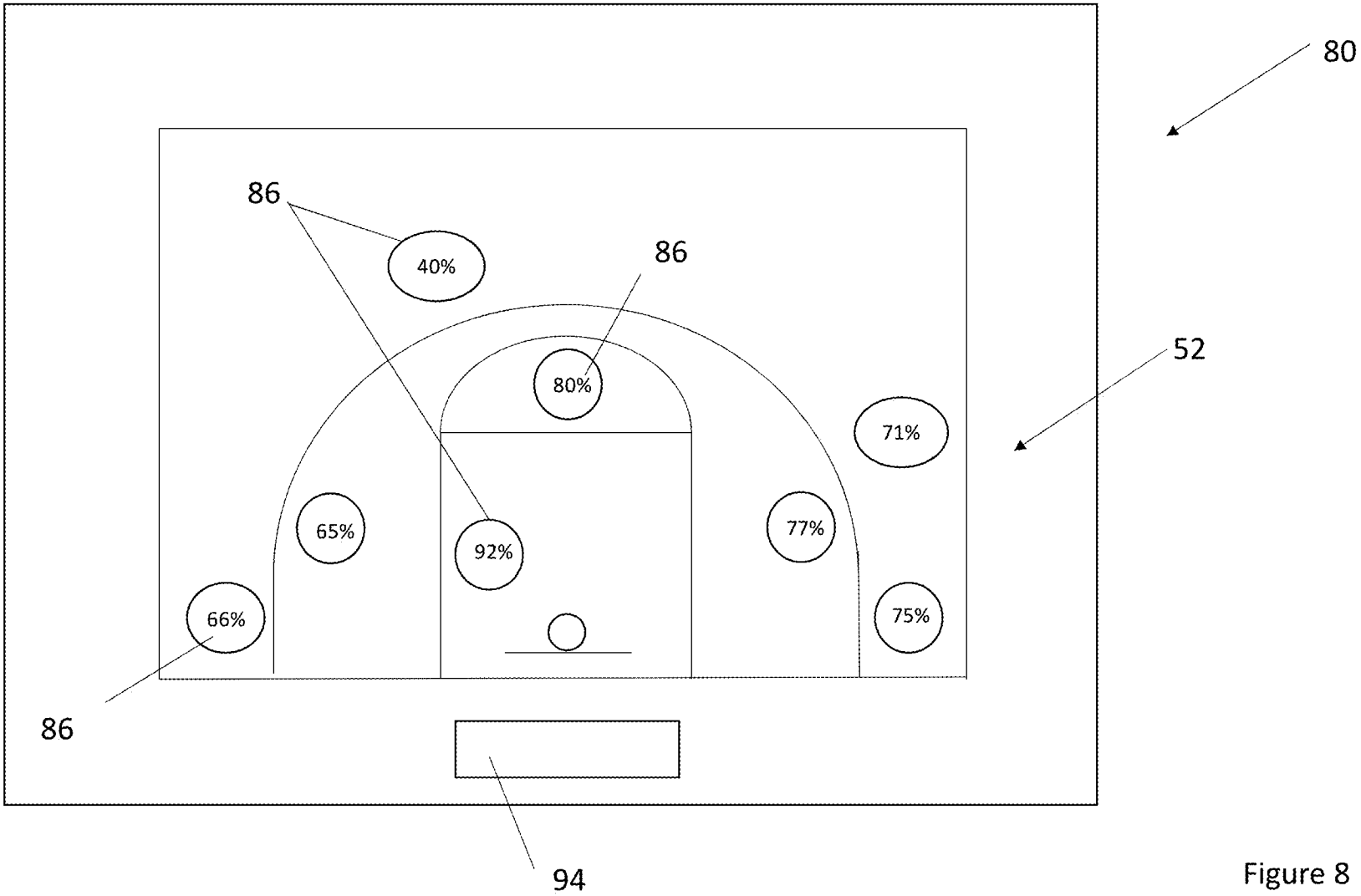
FIG. 8 is a detailed view of the interface of FIG. 3 with an exemplary performance report.

FIG. 8 illustrates the interface 50 with an exemplary performance report 80 for a given practice session. The report 80 may comprise the rendering 52 of the playing area 30, though such is not required. The rendering 52 may be the same or different from the rendering 52 provided at other displays.

The performance report 80 may comprise shooting feedback 86 located at, and corresponding to, substantially each of the selectable areas 62 forming the practice arrangement. The feedback 86 may comprise a number of made shots, a number of missed shots, a percentage of made shots, a percentage of missed shots, a grade, a pass/fail indication, some combination thereof, or the like. The feedback 86 may be provide in the same or similar form, such as but not limited to, shape, font, color, size, some combination thereof, or the like, as the selectable areas 62. For example, without limitation, the selectable areas 62 and the feedback 86 may comprise circles. In this way, the user may be able to quickly ascertain their strong and weak shooting positions. An overall number and/or percentage of made and/or missed shots, or other information, may be displayed at a second area 94.

The performance report 80 may be displayed at the interface 50. The performance report 80 may be generated at the controller 68, the interface 50, the personal electronic device 70, some combination thereof, or the like.

In other exemplary embodiments, the interface 50, or a copy thereof, may be provided on the personal electronic device 70 in addition to, or alternatively to, at the basketball launching machine 10. It is notable that the user of the interface 50 may be the basketball player 72 or may be some other individual such as, but not limited to, a friend, parent, coach, assistant, or the like.

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

Certain operations described herein may be performed by one or more electronic devices. Each electronic device may comprise one or more processors, electronic storage devices, executable software instructions, and the like configured to perform the operations described herein. The electronic devices may be general purpose computers or specialized computing device. The electronic devices may comprise personal computers, smartphone, tablets, databases, servers, or the like. The electronic connections and transmissions described herein may be accomplished by wired or wireless means. The computerized hardware, software, components, systems, steps, methods, and/or processes described herein may serve to improve the speed of the computerized hardware, software, systems, steps, methods, and/or processes described herein.

What is claimed is:

1. A system for automatically detecting made and missed basketball shots, said system comprising:

a frame;

a launcher connected to said frame and configured to pass basketballs to shooting locations about a basketball playing area having a basketball goal;

a camera connected to said frame and configured to, at least in part by orientation of said camera, capture images of an underside of a rim of said basketball goal;

an interface configured to receive user input selecting certain of the shooting locations at the basketball playing area for the launcher to pass said basketballs to as part of a basketball practice arrangement; and one or more controllers in electronic communication with said interface and said launcher, wherein said one or more controllers comprises software instructions stored at one or more electronic storage devices, which when executed, configure one or more processors to:

receive data indicating said user input from said interface;

program said launcher to pass at least one of said basketballs to each of said shooting locations of said basketball practice arrangement;

receive images from said camera;

associate each of said received images with a respective one of said passes of said basketball practice arrangement;

process each of said received images using a machine vision model to determine which of said received images indicate a made shot; and generate a performance report comprising a number or percentage of made shots for each of said shooting locations of said basketball practice arrangement in accordance with said processed images.

2. The system of claim 1 wherein:

said performance report comprises a rendering of basketball court lines and the number or percentages of made shots provided at locations at the rendering corresponding to said shooting locations of said basketball practice arrangement.

3. The system of claim 1 wherein:

the machine vision model is configured to determine that a respective one of said received images indicates a made shot where the machine vision model determines that the respective one of the received images comprises a basketball intersecting a front portion of the rim.

4. The system of claim 1 wherein:

the machine vision model is configured to determine that a respective subset of successive ones of said received images indicates a made shot where the machine vision model determines that the respective subset of successive ones of said received images comprise a progression of said basketball through said rim.

5. The system of claim 1 wherein:

the machine vision model is configured to determine that a respective one of said received images indicates a missed shot where the machine vision model determines that the respective one of the received images does not comprise the basketball.

6. The system of claim 1 further comprising:

additional software instructions stored at the one or more electronic storage devices, which when executed, configure the one or more processors to:

receive a dataset of images comprising a first subset of images without basketballs, a second subset of images with basketball passing through the rim, and a third subset of images with basketballs not passing through the rim;

receive data from a manual review and categorize categorization of the dataset of images indicating that each of the images in the second subset of images is a made shot and each of the images in the first subset of images and the second subset of images is a missed shot;

process the dataset of images through a neural network to categorize each of the images in the dataset of images as indicating a made shot or a missed shot; and if the categorization from the processed dataset is accurate in comparison with the data from the manual review and categorization above a target threshold, set the neural network as the machine vision model.

7. The system of claim 1 further comprising:

additional software instructions stored at the one or more electronic storage devices, which when executed, configure the one or more processors to, display movement instructions for a player at the interface as part of the basketball practice arrangement.

8. The system of claim 1 wherein:

said interface comprises a touch screen; and said interface is connected to said frame.

9. The system of claim 1 wherein:

said interface comprises a smartphone, tablet, or personal computer in wireless electronic communication with said one or more controllers.

10. The system of claim 1 further comprising:

a pre-programmed drill option provided at said interface, wherein said user input comprises selection of the pre-programmed drill option such that said certain of said shooting locations for the launcher to pass said basketballs to as part of the basketball practice arrangement are automatically determined following selection of said pre-programmed drill option.

11. The system of claim 1 wherein:

said interface comprises a rendering of basketball court lines and a number of selectable areas provided about said rendering at locations representing the shooting locations at the basketball playing area; and said selectable areas are visible prior to selection or are only visible following selection.

12. The system of claim 11 wherein:

said basketball court lines comprise a three-point arc.

13. A method for automatically detecting made and missed basketball shots, said method comprising the steps of:

receiving, at an interface comprising a rendering of basketball court lines, a user selection of certain ones of a plurality of selectable areas forming to define, at least in part, a custom practice arrangement;

programming, by way of a controller in electronic communication with said interface, a launcher to automatically pass at least one basketball to each of a plurality of shooting locations at a basketball player surface associated with said certain ones of said plurality of selectable areas defining said custom practice arrangement for a player to catch and throw towards said basketball goal;

capture, by way of a camera oriented to view an underside of a rim of a basketball goal, images of the underside of the rim of the basketball goal during said custom practice arrangement;

associating, by way of said controller, said captured images with said passes from said launcher;

analyzing, using a machine vision model, said captured images to determine which of said captured images indicate a made shot;

associating made shots with the passes of said custom practice arrangement associated with the captured images indicating the made shots; and associating missed shots with the passes not associated with made shots for said custom practice arrangement.

14. The method of claim 13 wherein:

said plurality of selectable areas are spaced apart along said basketball court lines to correspond with, on a one-to-one-basis, shooting locations on a basketball playing area;

said plurality of selectable areas are visible prior to selection or are only visible following selection;

said interface comprises a touchscreen; and said user selection is received by way of direct, physical touch of each of said selectable areas forming said custom practice arrangement.

15. The method of claim 13 further comprising the steps of:

receiving a dataset of training images of the underside of the basketball rim comprising a first subset of images without a basketball, a second subset of images with a basketball not passing through the rim, and a third subset of images with a basketball passing through the rim;

processing each of said training images in said dataset through a neural network to categorize each of said training images as representing a made shot or a missed shot;

determining that said neural network achieves at least a predetermined level of accuracy when compared against a manual categorization of the training images; and setting said neural network as said machine vision model.

16. The method of claim 15 wherein:

the machine vision model categorizes each of a first subset of said captured images as representing a made shot where the first subset of said captured images each depict the basketballs intersecting a front portion of the rim; and the machine vision model categorizes each of a second subset of said images as representing a missed shot where the second subset of said captured images does not depict the basketball intersecting the front portion of the rim.

17. The method of claim 15 wherein:

the machine vision model categorizes each of a first subset of said captured images as representing a made shot where a progression of said captured images in said a first subset of said captured images depicts the basketballs passing through the rim; and the machine vision model categorizes each of a second subset of said captured images as representing a missed shot where the progression of said captured images in said second subset of said captured images does not depict the basketball or depicts the basketball not passing through the rim.

18. The method of claim 13 further comprising the steps of:

generating, for display at the interface, a performance report comprising the rendering and a shooting efficiency percentage for each of said selectable areas of said custom practice arrangement.

19. The method of claim 13 further comprising the steps of:

positioning the launcher below the basketball goal such that said camera is positioned to view the underside of the rim of the basketball goal, wherein said interface, said camera, and said launcher are connected to a frame.

20. A system for automated detection of made and missed basketball shots, said system comprising:

a frame configured for placement below a basketball goal;

a collection net extending about at least some of said frame, wherein a front upper edge of said collection net is configured for extension above a rim of the basketball goal when said frame is placed below the basketball goal and said net is placed in an expanded position;

a launcher connected to said frame and configured to rotate and pass basketballs to each of a plurality of shooting locations spaced apart in an arcuate manner at a basketball playing area;

a camera connected to said frame and oriented in an upward facing direction to capture images of an underside of the rim of the basketball goal when said frame is positioned below said basketball goal;

an interface comprising a touch screen connected to said frame and configured to generate a rendering of a three-point arc and receive user input by way of direct physical touch at certain ones of a plurality of selectable areas for one-to-one selection of a subset of the shooting locations corresponding with the locations physically touched at the interface; and a controller in electronic communication with said interface and said launcher, wherein said controller comprises software instructions stored at one or more electronic storage devices, which when executed, configure one or more processors to:

receive said user input from said interface indicating selection of said certain ones of said selectable areas to define said custom practice arrangement;

program said basketball launcher to pass at least one of the basketballs to each of said shooting locations in said subset corresponding to each of said certain ones of said selectable areas defining said custom practice arrangement;

receive one or more images from said camera following each of said basketball passes made by said launcher as part of said custom practice arrangement;

associate each of said basketball passes made by said launcher as part of said custom practice arrangement with at least one of said received images;

process each of said received images with a validated neural network machine vision model to determine which shooting attempts resulted in a made shot and which of said shooting attempts resulted in a missed shot, wherein each of said shooting attempts is associated with one of said basketball passes made by said launcher as part of said custom practice arrangement; and generate a performance report comprising the rendering and a percentage of made shots for each of said shooting locations in said subset, wherein said percentages of made shots for each of said shooting locations in said subset are in relationship to said rendering in a manner visually correspondent with the certain ones of the selectable areas.

21. The system of claim 20 wherein:

said validated neural network machine vision model is configured to register the made shots where said received images comprise a basketball intersecting a front portion of said rim.

* * * * *